United States Patent [19]

Holden

[11] 4,217,465

[45] Aug. 12, 1980

[54] SPLICE BOOT WITH RETENTION MEANS

[75] Inventor: Paul J. Holden, Pacific Palisades, Calif.

[73] Assignee: Alta Products Company, Newbury Park, Calif.

[21] Appl. No.: 931,480

[22] Filed: Aug. 7, 1978

[51] Int. Cl.[2] ..... H01R 13/56; H01R 13/58; H01B 17/58

[52] U.S. Cl. ..... 174/138 F; 174/71 R; 174/74 A; 339/101; 339/103 R; 339/107

[58] Field of Search ..... 174/65 G, 71 R, 72 R, 174/74 A, 135, 138 F, 152 G, 153 G, 167; 285/155, 260, DIG. 22; 339/101, 103 R, 103 C, 103 M, 107, 208, 213 R

[56] References Cited

U.S. PATENT DOCUMENTS

| | | | |
|---|---|---|---|
| 2,922,667 | 1/1960 | Lanciano, Jr. | 285/260 |
| 3,671,921 | 6/1972 | Baker et al. | 339/103 M X |
| 3,911,203 | 10/1975 | Goldowsky | 174/74 A X |
| 3,986,765 | 10/1976 | Shaffer et al. | 339/103 R X |

FOREIGN PATENT DOCUMENTS

| | | | |
|---|---|---|---|
| 442197 | 2/1936 | United Kingdom | 339/101 |

*Primary Examiner*—Laramie E. Askin
*Attorney, Agent, or Firm*—Ralph B. Pastoriza

[57] ABSTRACT

The splice boot comprises retention means for holding an exit end portion of the boot to a connector block. The retention means take the form of integrally formed parallel rib segments on the exterior of the exit end of the splice boot such that part of a connector block abuts against the rear ends of the ribs to secure the boot to the connector block.

3 Claims, 4 Drawing Figures

SPLICE BOOT WITH RETENTION MEANS

BACKGROUND OF THE INVENTION

This invention relates to splice boots for electrical wires and more particularly to multi-fingered splice boots for covering separated groups of wires from a telephone cable for subsequent connection to connector blocks.

Splice boots of the type under consideration generally comprise a tubular entrance portion with two or more tubular exit portions all connected at first ends to the entrance portion. With this arrangement, multiple wires from a cable such as a telephone cable can be divided into separate groups of wires and the same fed through the entrance tubular portion of the splice boot and individual groups brought out the exit end portions. Where there are only two exit end portions, the splice boot takes the form of an integral Y-shaped structure.

Normally, the separated wire groups extending from the exit tubular portions of the splice are connected to a connector block and in order that the wire groups be properly protected, the exit end of the exit tubular portion is nested in this block with or without appropriate retention means.

Heretofore, one form of retention means has taken the form of a single raised rib or projection integrally formed on the exterior end portion of each exit tubular portion. This raised rib or projection extends in a circumferential direction and is arranged to have its rear surface engaged or abutted by a clamp constituting part of the connector block structure when the exit tubular portion is nested in the connector block. Hopefully, this type of retention will prevent pulling of the exit tubular portion of the boot away from the connector block. However, problems have been encountered. More particularly, thin plastic material is normally employed for making up the splice boot and the provided transversely extending rib or projection tends to simply be "bent forwardly" when a strong pulling force is applied on the splice boot such that it slips under the clamp and the exit tubular portion of the boot is thus no longer secured to the connecting block.

SUMMARY OF THE INVENTION

With the foregoing considerations in mind, the present invention contemplates the provision of a novel splice boot and retention means overcoming the above problem of possible failure and separation of the splice boot from the connector block.

More particularly, in accord with this invention retention means are integrally formed on the end of a single splice boot sleeve or cable insulator or, for multi-fingered splice boots, on the exterior of each of the ends of the exit tubular portions. This retention means takes the form of longitudinally extending rib means of given width, length and height. These ribs means function to retain more permanently and more reliably the exit tubular portion on a connecting block when a clamp or other portion of the block is positioned over the exit tubular portion immediately to the rear of the rib means.

Because the rib means runs longitudinally, the risk of a "bending forwardly" of the retention means under pulling forces and working loose of the boot is substantially reduced.

BRIEF DESCRIPTION OF THE DRAWINGS

A better understanding of this invention will be had by referring to a preferred embodiment as illustrated in the accompanying drawings in which.

DETAILED DESCRIPTION OF THE PREFERRED EMBODIMENT

Figure 1:
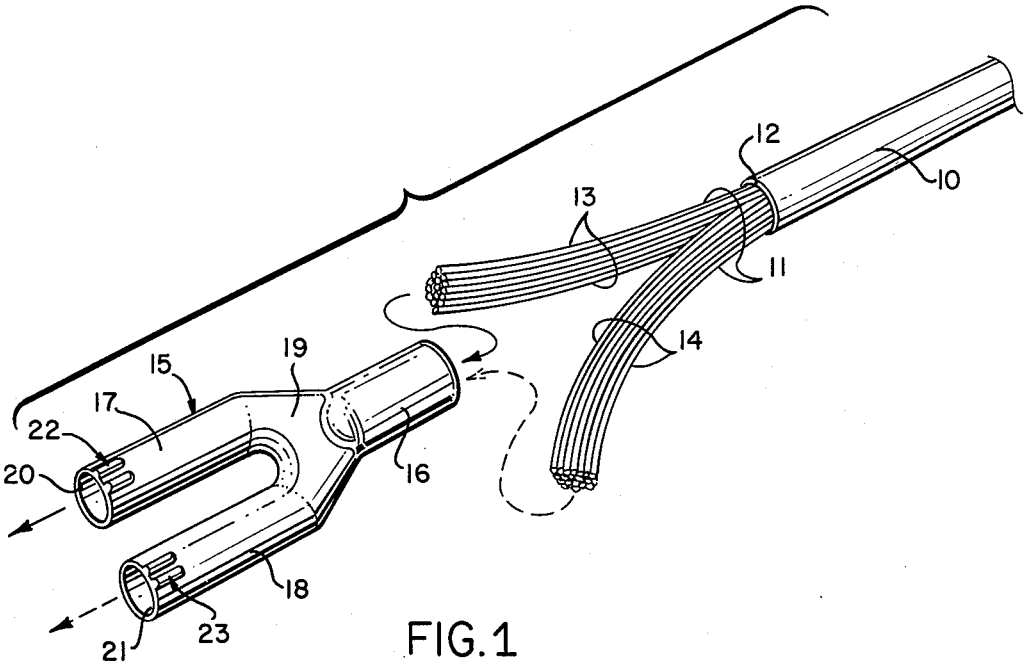
FIG. 1 is a perspective view of one type of splice boot of the present invention preparatory to receiving separated wire groups from a multiple wire cable.

Referring first to FIG. 1, there is shown a single multiple wire cable 10 from which multiple wires 11 extend from a cut portion 12 of the insulating jacket of the cable 10. Wires 11 in turn are shown divided into wire groups 13 and 14 for connection to appropriate connecting blocks as will be described subsequently.

While the multiple wires 11 are shown divided only into two wire groups 13 and 14, there may be many more such wire groups. It will be understood that the individual wires in each of the groups are for a particular branch telephone system at one location and thus are appropriately grouped together.

Because the insulating jacket has been cut away as shown at 12, it is desirable to cover the extending wire groups between their exit point from the insulation jacket and the particular connector blocks. For this purpose, there is provided a splice boot indicated generally by the arrow 15 in FIG. 1. The splice boot shown has only two extending fingers but as mentioned, if more than two wire groups are provided, the splice boot would have a corresponding number of additional fingers.

Considering specifically the splice boot 15, the structure comprises flexible plastic material formed to provide an entrance tubular portion 16 for receiving all of the multiple wires 11 from the end of the multiple wire cable 10. At least two exit tubular portions 17 and 18 in turn integrally connect to the entrance tubular portion 16 at first ends to define an integral Y structure as shown. With this arrangement, the two wire groups 13 and 14 are fed successively into the entrance tubular portion 16 and out respective second ends 20 and 21 of the exit tubular portions 17 and 18.

Thus, as indicated by the solid arrow in FIG. 1, the first wire group 13 would be passed into the entrance tubular portion 16 and out the exit tubular portion 17. Thereafter, as indicated by the dashed arrow in FIG. 1, the second wire group 14 would be passed into the entrance tubular portion 16 and guided out the other exit tubular portion 18.

Also shown on the splice boot 15 of FIG. 1, are retention means 22 and 23 formed on the exterior second end portions of the exit tubular portions 17 and 18. These retention means will be described in greater detail subsequently.

Figure 2:
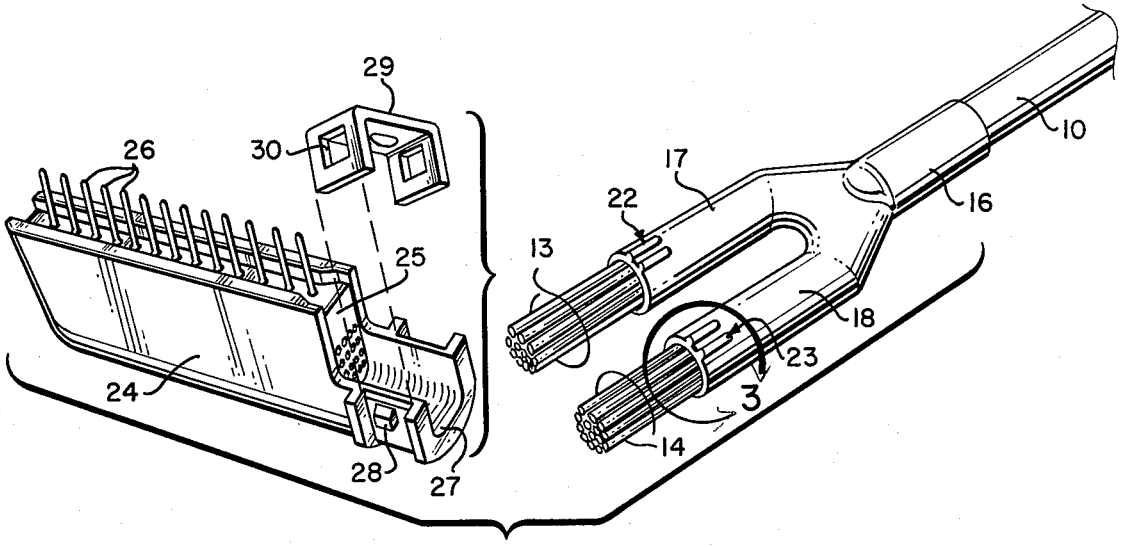
FIG. 2 is a perspective view of the splice boot of FIG. 1 after being applied to the wire groups of the cable preparatory to the wire groups being connected to connector blocks.

Referring now to FIG. 2, the splice boot described in FIG. 1 is shown in proper position covering the multiple wires 11 from the cable 10 and the wire groups 13 and 14.

Shown to the left of the splice boot in FIG. 2 is one type of connector block 24 to which, for example, the wires making up the wire group 14 are to be connected. A similar block connector would be provided for the wires in the wire group 13 but is not shown. Other type connector blocks could be used.

Considering in detail the connector block 24, this structure includes an outer plastic casing supporting a connector 25 receiving the various individual wires and effecting an electrical connection from the wires to appropriate male prongs or pins 26. A female connector (not shown) is designed to receive the prongs 26 and complete electrical connections between the individual wires and other telephone circuits at a particular branch.

In order to assure the integrity of the connections of the individual wires of the wire group 14 to the various pins 26 in the connector 25, the casing of the connector block 24 includes a cradling portion 27. As shown, opposite exterior walls of the cradle portion 27 include small projections 28 for cooperation with a clamp 29 shown exploded above the cradle portion. Clamp 29 has downwardly extending sides with window openings such as indicated at 30. The arrangement is such that when the clamp 29 is positioned over the cable, the projections 28 will snap into the window 30 and thus lock the clamp in place.

Figure 3:
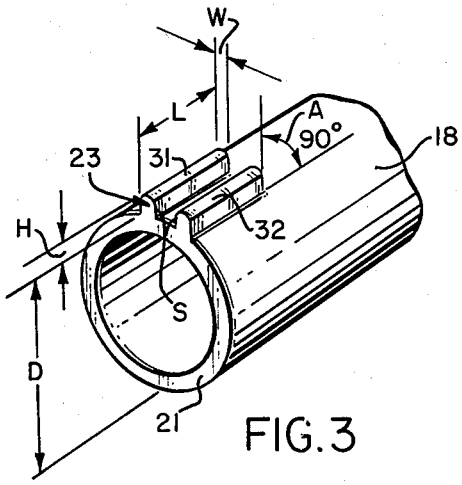
FIG. 3 is an enlarged fragmentary perspective view of the portion of the splice boot enclosed within the circular arrow 3 of FIG. 2 and, FIG. 4 is a fragmentary side elevational view showing connection of one exit end portion of the splice boot to the connector block shown in FIG. 2.

Referring now to FIG. 3, the retention means 22 and 23 for the exit tubular portions of the splice boot will now be described in detail. The retention means are all identical so that a detailed description of one will suffice for all.

Thus referring specifically to the retention means 23 for the exit tubular portion 18 shown in FIG. 3, the means takes the form of at least two longitudinally extending rib segments 31 and 32 starting at the exit opening of the exit tubular portion and running longitudinally rearwardly in spaced parallel relationship. Each rib segment terminates in a straight edge normal to the exterior surface of the tubular portion 18 to provide an abutting surface for the clamp as will be subsequently described. This arrangement of the rib segment ends is indicated by the 90° angle A as designated in FIG. 3.

The rib segments 31 and 32 each have a given width W length L and height H. The spacing between the parallel rib segments 31 and 32 is indicated by the letter S.

If D represents the outside diameter of the exit tubular portion 18, then the height H and width W of each rib segment is from 1/50 to 1/5 this outside diameter D and the length L of each segment is at least four times the width W. The spacing between the two ribs is from ½ to four times the width W of each rib segment.

Figure 4:
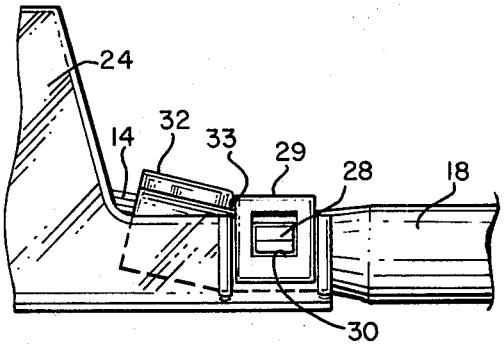

Referring now to FIG. 4, the exit tubular portion 18 with its associated wire group 14 is shown cradled in the connector block 24 with the clamp 29 secured over the tubular portion such that it is immediately to the rear of the longitudinal ribs as clearly shown for the rib 32. Abutting contact thus takes place at 33 between the clamp and the straight rear end of each of the rib segments.

It will be evident from FIG. 4 that any pulling force on the exit tubular portion 18 away from the connector block 24 will not result in separation because of this abutment of the retention means in the form of the rib segments with the clamp.

With respect to the foregoing, because the longitudinal length of each of the rib segments is at least four times the width and height of the segment, it is less likely for the ribs to "bend forwardly" or work their way under the clamp 29. In other words, the longitudinal extent of the retention means provides for a firm abutment even though the plastic material of the exit tubular portion 18 is thin and flexible.

It has been found in practice that the unique geometry of the retention means as described provides for a vast improvement in the integrity of a splice boot securement to a connector block, all to the end that the splice boot itself is retained in proper operative position for protecting the various multiple wires from a main cable.

The term "splice boot" in its broadest aspect as used herein is meant to include any sheathing or insulative covering for electrical wire.

I claim:

1. A splice boot for covering multiple wire groups extending from the end of a single multiple wire cable for connection to connecting blocks, said boot including:

(a) an entrance tubular portion for receiving all of the multiple wires from the end of said multiple wire cable;

(b) at least two exit tubular portions integrally connected to said entrance tubular portion at first ends to define an integral Y structure so that the multiple wires from the ends of said multiple wire cable can be divided into at least two wire groups and fed into said entrance tubular portion and out respective second ends of said two exit tubular portions for connection to said connecting blocks; and (c) retention means integrally formed on the exterior of each of the second ends of said exit tubular portions in the form of longitudinally extending rib means of given width, length and height, said length being at least four times said width, said rib means starting at the exit opening of the exit tubular portion and running longitudinally rearwardly to terminate in a straight end edge normal to the exterior surface of said tubular portion to provide abutting means to retain the exit tubular portion on a connecting block when a clip on the block is positioned over said exit tubular portion immediately to the rear of said rib means to engage said abutting means.

2. A splice boot according to claim 1, in which said longitudinally extending rib means includes at least two rib segments starting at the exit opening of the exit tubular portion and running longitudinally rearwardly in spaced parallel relationship.

3. A splice boot according to claim 2, in which the height and width of each rib segment is from 1/50 to 1/5 the outside diameter of said exit tubular portion and the spacing between the two rib segments is from ½ to four times the width of each rib segment.

* * * * *